United States Patent [19]

Monto

[11] Patent Number: 4,962,850

[45] Date of Patent: Oct. 16, 1990

[54] CIGARETTE BOX WITH INTERIOR MATCHES

[76] Inventor: Mark Monto, 1 Blueberry Bend, West Orange, N.J. 07052

[21] Appl. No.: 486,297

[22] Filed: Feb. 28, 1990

[51] Int. Cl.[5] ..... B65D 85/10

[52] U.S. Cl. ..... 206/92; 206/90

[58] Field of Search ..... 206/85, 86, 90–95, 206/105, 115

[56] References Cited

U.S. PATENT DOCUMENTS

| | | | |
|---|---|---|---|
| 827,558 | 7/1906 | Niell . | |
| 944,954 | 12/1909 | Davis . | |
| 1,175,336 | 3/1916 | Brugila | 206/92 |
| 1,466,225 | 8/1923 | Heffner | 206/92 |
| 1,943,052 | 1/1934 | Berry, Jr. | 206/94 |
| 2,107,042 | 2/1938 | MacMillan, Jr. . | |
| 2,163,326 | 6/1939 | Schwartz . | |
| 2,230,867 | 2/1941 | Kuehpuss . | |
| 2,295,110 | 9/1942 | Harkleroad . | |
| 2,484,327 | 10/1949 | Williams . | |
| 2,811,247 | 10/1957 | Stevenson . | |
| 2,894,619 | 7/1959 | Gallo . | |
| 3,012,661 | 12/1961 | Kennard . | |
| 3,032,178 | 5/1962 | Graifman . | |
| 3,444,992 | 5/1969 | Kursteiner . | |
| 3,509,989 | 5/1970 | Woll . | |
| 3,915,295 | 10/1975 | Morrison . | |
| 4,164,999 | 8/1979 | Tsukamoto . | |
| 4,836,366 | 6/1989 | Mikhail . | |

FOREIGN PATENT DOCUMENTS

| | | | |
|---|---|---|---|
| 0462759 | 1/1950 | Canada | 206/92 |
| 0374178 | 8/1939 | Italy | 206/92 |
| 0188172 | 12/1936 | Switzerland | 206/92 |
| 0196232 | 4/1923 | United Kingdom | 206/92 |
| 0348133 | 4/1931 | United Kingdom | 206/93 |

*Primary Examiner*—Jimmy G. Foster

*Attorney, Agent, or Firm*—Thomas L. Adams

[57] ABSTRACT

A cigarette box has a flip top lid. This lid has a top and at least three sides. The lid has a pair of spaced flaps swingably attached at opposing positions inside the lid. These flaps can swing into an interior position parallel to the top. The cigarette box includes a plurality of matches attached to at least one of the flaps. The matches can swing into a position parallel to the top.

8 Claims, 2 Drawing Sheets

CIGARETTE BOX WITH INTERIOR MATCHES

BACKGROUND OF THE INVENTION

The present invention relates to cigarette boxes, and, in particular, to boxes having matches secured inside the cigarette box.

It is known to fabricate a cigarette package with matches attached to it in some fashion. It is desirable when designing a cigarette box with matches to keep the size and shape of the box about the same as a conventional box without matches. Known cigarette boxes have stored matches in inconvenient positions, such as parallel to the cigarettes. Such orientations increases the thickness of the package and impedes retrieval of the matches.

In U.S. Pat. No. 2,163,326 a cigarette package has a recess into which matches are fitted. Access to this recess is gained by ripping open this compartment. Thus this package is inconvenient to use. This reference also does not disclose how matches could be secured conveniently with a conventional flip top lid.

Other cigarette or cigar packages or containers are shown in U.S. Pat. Nos. 827,558; 944,954; 2,107,042; 2,230,867; 2,295,110; 2,484,327; 2,811,247; 2,894,619; 3,012,661; 3,032,178; 3,444,992; 3,509,989; 3,915,295; 4,164,999; and 4,836,366.

Accordingly, there is a need for an improved way of securing matches to a cigarette box so that the matches are easily accessible and the size and shape of the box are not adversely affected.

SUMMARY OF THE INVENTION

In accordance with the illustrative embodiments demonstrating features and advantages of the present invention there is provided a cigarette box having a flip top lid. This lid has a top and at least three sides. The lid has a pair of spaced flaps swingably attached at opposing positions inside the lid. These flaps are swingable into an interior position parallel to the top. The box includes a plurality of matches attached to at least one of the flaps and swingable into a position parallel to the top.

By employing a cigarette box with matches attached in the foregoing fashion an improved package is achieved. In the preferred embodiment, matches are secured to flaps that are swingable into a parallel relation with the top of the flip top lid. Preferably, a set of matches fabricated from a comb-like card are glued to interior faces of both of these flaps. Accordingly, there will be two opposing rows of matches, each row swingable about a different opposing axis. Preferably, the matches are so long that one row of matches overlaps the other row.

Being positioned on such flaps lengthwise and parallel to the flip top lid, the matches occupy very little space and are immediately visible when the smoker opens the box. Furthermore, because of the positioning, the package is compact and shaped much like the conventional box.

BRIEF DESCRIPTION OF THE DRAWINGS

The above brief description, as well as other objects, features and advantages of the present invention will be more fully appreciated by reference to the following detailed description of presently preferred but nonetheless illustrative embodiments in accordance with the present invention taken in conjunction with the accompanying drawings wherein.

DETAILED DESCRIPTION OF PREFERRED EMBODIMENTS

Figure 1:
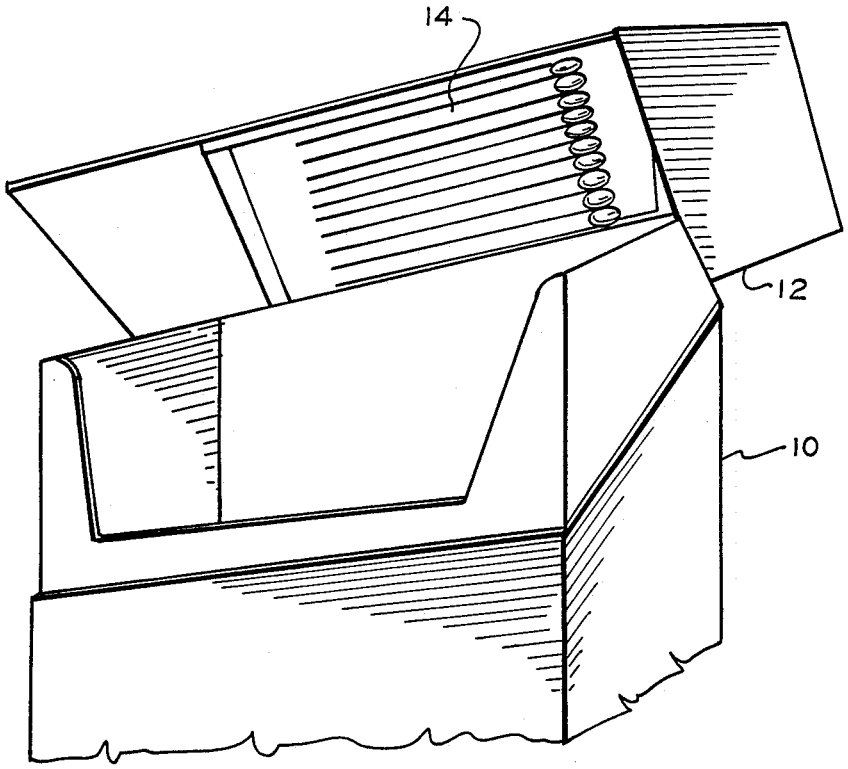
FIG. 1 is a perspective view of a cigarette box with its lid open to show matches installed in accordance with principles of the present invention.

Referring to FIG. 1, a cigarette box 10 is shown as a rectangular package having a flip top lid 12. The box, except for the lid and its accessories, may be fabricated the same as flip top cigarette boxes currently in commerce, for example, the flip top box sold under the trademark Marlboro. Ten matches 14 are shown secured to the inside of the top of lid 12.

Figure 2:
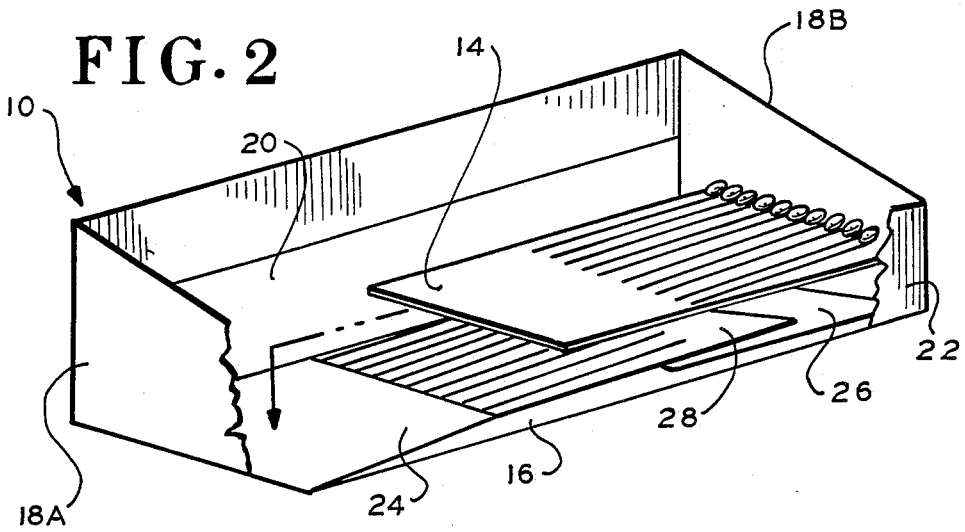
FIG. 2 is a separately illustrated perspective of the lid and matches of FIG. 1, with portions of sides of the lid broken away for clarity.

Referring to FIG. 2, lid 10 is shown having a top 16 and short sides 18A and 18B. Lid 10 also has a long side 20 which is taller than long side 22 (the latter and side 18A being partially broken away for illustrative purposes.

Parallel to the top 16 are a pair of swingable flaps 24 and 26, which articulate near the junction of top 16 with sides 18A and 18B, respectively. As shown herein, matches 14 are about to be glued to the interior surface of flap 24, as indicated by the dotted line. Underlying matches 28 are shown glued to the interior surface of flap 26. In this embodiment, matches 14 and 28 are a comb-like structure formed of cardboard. Essentially, a rectangular cardboard is slit as illustrated to provide a comb-like structure with ten matches. The matches can be removed in the usual fashion. The tips of the matches are coated with a conventional ignitable material.

Figure 4:
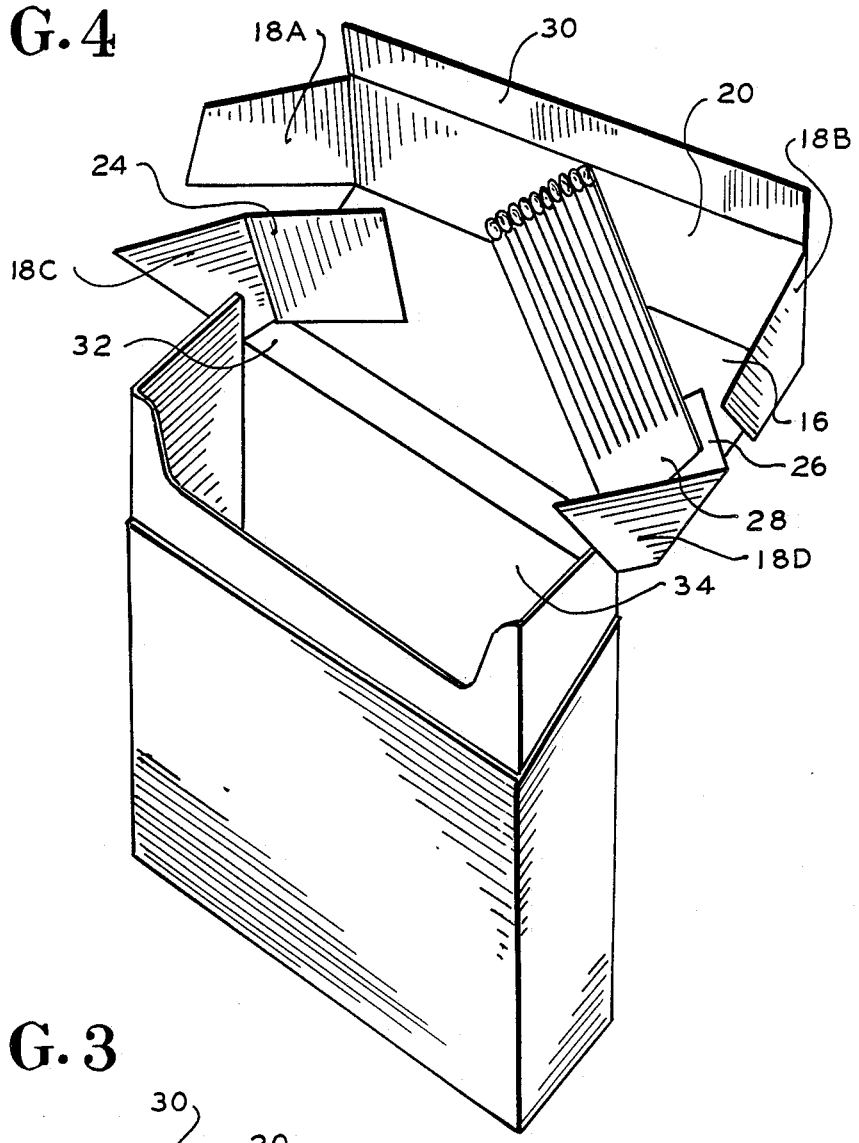
FIG. 4 is a perspective view of the box of FIG. 1, but only partially assembled.
Figure 3:
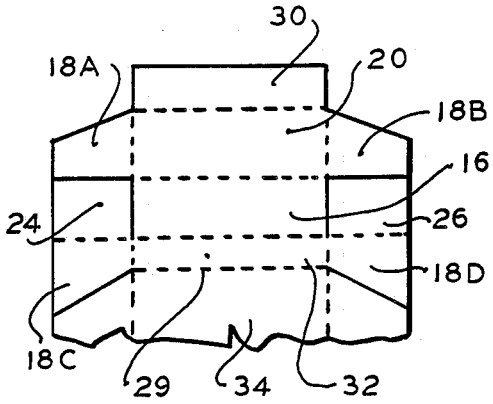
FIG. 3 is a developmental view of the folds and slits for making the lid of FIG. 1.

Referring to FIGS. 3 and 4, the assembly of the lid is illustrated in greater detail. The development of FIG. 3 is the inside view of the lid prior to assembly. In this cardboard development, the dotted lines indicate a fold and the solid lines a cut. Each of the fold lines in FIG. 3 are to be folded concavely, except for fold line 29. Panel 30 is folded against and glued to the inside surface of side 20 to reinforce the exposed edge of side 20. Flaps 24 and 26 are folded up at right angles toward sides 18C and 18D. Sides 18C and 18D are then folded at right angles to panel 32. Thereafter, side 20 can be folded at right angles to top 16 and top 16 can be folded at right angles to panel 32.

The relative orientation of the various panels is illustrated in FIG. 4 where none of the panels have been glued but are bent nearly into the position they would occupy after folding and gluing. In particular, the interior face of side 18A will be glued to the exterior face of side 18C. Similarly, the interior face of side 18B will be glued to the exterior face of side 18D. Once folded and glued, sides 18A and 18B match in outline sides 18C and 18D, respectively.

Matches 28 (as well as matches 14 of FIG. 2) can be glued to the appropriate flap (flap 24 and 26) either prior to or after assembling the lid. The matches are glued to the internal face of flaps 24 and 26, so that the two rows of matches overlap one another.

The matches are made somewhat narrower than conventional match books. This narrowing of the matches enables ten to fit on each of the flaps 24 and 26. It will be appreciated, however, that in other embodiments a different number of matches can be installed. Also, in some embodiments, instead of glueing, the matches can be affixed by staples or other means. Also, in other embodiments, one or more of the flaps can be made long enough so that it can be formed into a row of matches by itself. Such an elongated flap can be slit and tipped with combustible material in the usual fashion to provide integral matches.

Figure 5:
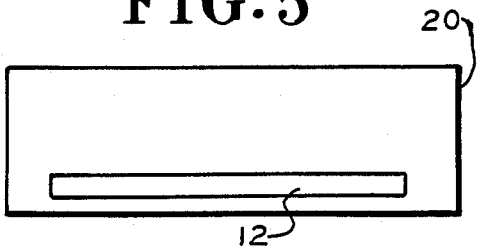
FIG. 5 is a top view of the lid of FIG. 1.

Referring to FIG. 5, the outside face of top 20 is shown with a striker 42. Striker 42 may be the material typically found in the striker of a match book. Striker 42 may be applied to top 20 as a granular paste that is applied to top 20 and allowed to dry. Other types of striker materials can, of course, be installed onto top 20.

The box can be filled with cigarettes (not shown) and the lid closed. A smoker can open the lid and remove one of the cigarettes. Thereafter, one of the matches 14 can be removed in the usual fashion. Thereafter, the lid can be closed and the match ignited by rubbing it against striker 42 (FIG. 5). When all of the matches 14 are removed, the matches 28 are exposed. These can then be made more accessible by lifting them so they lie over flap 24. Thereafter, matches 28 can be used in an identical fashion.

It is to be appreciated that various modifications may be implemented with respect to the above described preferred embodiments. For example, the number and size of the matches can be altered depending upon space restrictions, the number of cigarettes etc. Also, while cardboard matches are shown, in some embodiments, other material can be used, including thin slit wood or ignitable fiberboard. Furthermore, the matches can be secured to either side of the illustrated flaps. In addition, only one of the flaps may be used to hold matches. Also, in some embodiments, the matches may be shortened so that the amount of overlap is reduced or possibly eliminated, provided the match length is sufficient to avoid injury from burning materials. Moreover, the ignitable material and the material used in the striker can be altered depending upon the desired ease of lighting, moisture resistance, length of burn etc.

Obviously, many modifications and variations of the present invention are possible in light of the above teachings. It is therefore to be understood that within the scope of the appended claims, the invention may be practiced otherwise than as specifically described.

What is claimed:

1. A cigarette box having a flip-top lid, said lid having a top and at least three sides, said lid having a pair of spaced flaps swingably attached at opposing positions inside said lid, said flaps being swingable into an interior position parallel to said top, said lid comprising:

a plurality of matches projecting from at least one of said flaps and swingable into a position parallel to said top.

2. A cigarette box according to claim 1 wherein said matches articulate in a plane perpendicular to said top.

3. A cigarette box according to claim 2 wherein said top has two short edges and two long edges, said matches articulating at least about an axis near one of said short edges, said matches being substantially perpendicular to said axis.

4. A cigarette box according to claim 3 wherein said plurality of matches are divided into two groups of matches, each of the two groups being attached to a different one of said flaps, the matches of said two groups articulating about two spaced axes each near a different one of said short edges.

5. A cigarette box according to claim 4 wherein said matches are attached to said flaps to overlap when positioned parallel to said top.

6. A cigarette box according to claim 5 wherein each of said groups of matches comprise a comb-like card.

7. A cigarette box according to claim 6 wherein said top has a striking material affixed to the outside of said top.

8. A cigarette box according to claim 7 wherein each of said groups of matches are glued to the inside face of a different one of said flaps, each of the groups of matches being equal in number.

* * * * *